US007094113B1

(12) United States Patent
Hasenour et al.

(10) Patent No.: US 7,094,113 B1
(45) Date of Patent: Aug. 22, 2006

(54) QUICK CONNECT TERMINAL ADAPTER FOR ELECTRONIC PACKAGES

(75) Inventors: Timothy Hasenour, Clemmons, NC (US); Randy Hannah, Kernersville, NC (US); Kurt T. Zarbock, Advance, NC (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 11/103,181

(22) Filed: Apr. 11, 2005

(51) Int. Cl.
*H01R 9/22* (2006.01)
*H01R 13/432* (2006.01)

(52) U.S. Cl. ..... 439/709; 439/746; 439/715

(58) Field of Classification Search ..... 439/709, 439/715, 716, 746
See application file for complete search history.

(56) References Cited

U.S. PATENT DOCUMENTS 2,872,506 A * 2/1959 Flubacker ..... 174/153 R
4,385,791 A * 5/1983 Lovrenich ..... 439/83
4,624,514 A * 11/1986 Smith ..... 379/412
4,853,960 A * 8/1989 Smith ..... 379/437
4,869,682 A * 9/1989 Volk et al. ..... 439/344

* cited by examiner

*Primary Examiner*—Tho D. Ta

(57) ABSTRACT

A terminal adapter for an electronic package having a stub terminal is provided. The adapter includes an adapter housing configured to be fitted over the electronic package and enclosing the terminal of the electronic package, a terminal receptacle formed in the housing, and at least one screw terminal assembly fitted within said terminal receptacle and locked thereto with deflectable mounting legs.

19 Claims, 3 Drawing Sheets

QUICK CONNECT TERMINAL ADAPTER FOR ELECTRONIC PACKAGES

BACKGROUND OF THE INVENTION

This invention relates generally to electronic packages, and more particularly, to terminal adapters for electronic packages.

Known electronic packages include terminals through which the packages are connected to electrical circuitry. To simplify installation of electronic packages in the field, solderless terminal connection schemes have been developed which include quick connect terminal connectors which slip on and slidably engage complementary quick connect terminals of the electronic package. Such quick connect terminals and connectors are available from, for example, Ark-Les Corporation of Stoughton, Mass., and are commonly used in electronic packages such as switching relay packages.

In certain installations, such quick connect terminals and connectors have been found to be disadvantageous. For example, screw terminations having a pressure plate and a screw which clamps wire conductors to the pressure plate are preferred in some electrical systems. Quick connect adapters are available from, for example, ABB Inc. of Zurich, Switzerland which include a slip-on quick connect feature at one end and a screw terminal at the other end, and thus convert the solderless terminals of the electronic package to screw terminals. Such adapters, however, have been found inadequate to handle the torque required in some applications as the screw is tightened. The quick connect end of the adapter tends to move with the screw once the torque achieves a threshold level and prevents the screw from being further tightened.

Additionally, the size and shape of known screw terminal adapters for quick connect terminals is not compatible with certain UL air gap requirements and surface spacing between the terminals. Thus, for example, when used with some known relay switch packages, the packages fail to achieve UL certification.

BRIEF DESCRIPTION OF THE INVENTION

According to an exemplary embodiment, a terminal adapter for an electronic package having a quick connect terminal is provided. The adapter includes an adapter housing configured to be fitted over the electronic package and enclosing the terminal of the electronic package, a terminal receptacle formed in the housing, and at least one screw terminal assembly fitted within said terminal receptacle and locked thereto with deflectable mounting legs.

According to another exemplary embodiment, a terminal adapter for an electronic package having a plurality of quick connect terminals is provided. The adapter includes an adapter housing configured to be fitted over the electronic package and enclosing the quick connect terminals of the electronic package, a plurality of terminal receptacles formed in the housing, wherein each of the terminal receptacles correspond to one of the quick connect terminals of the electronic package. The adapter further includes a plurality of screw terminal assemblies, each screw terminal assembly fitted within a respective one of the terminal receptacles, a portion of each screw terminal assembly projecting into retaining cavities formed into the terminal receptacles to prevent the screw terminal assemblies from moving with respect to the housing when said screw terminal assemblies are tightened.

According to still another exemplary embodiment, an electronic package assembly is provided. The electronic package assembly includes an electronic package having a plurality of quick connect terminals, and an adapter housing configured to be fitted over the electronic package and the quick connect terminals of the electronic package. The housing includes a plurality of terminal receptacles, wherein each of the terminal receptacles corresponds to one of the quick connect terminals of the electronic package. The assembly further includes a plurality of screw terminal assemblies, and each screw terminal assembly is fitted within a respective one of the terminal receptacles. A portion of each screw terminal assembly projects into retaining cavities formed into the terminal receptacles to prevent the screw terminal assemblies from moving with respect to said quick connect terminals when the screw terminal assemblies are tightened.

DETAILED DESCRIPTION OF THE INVENTION

Figure 1:
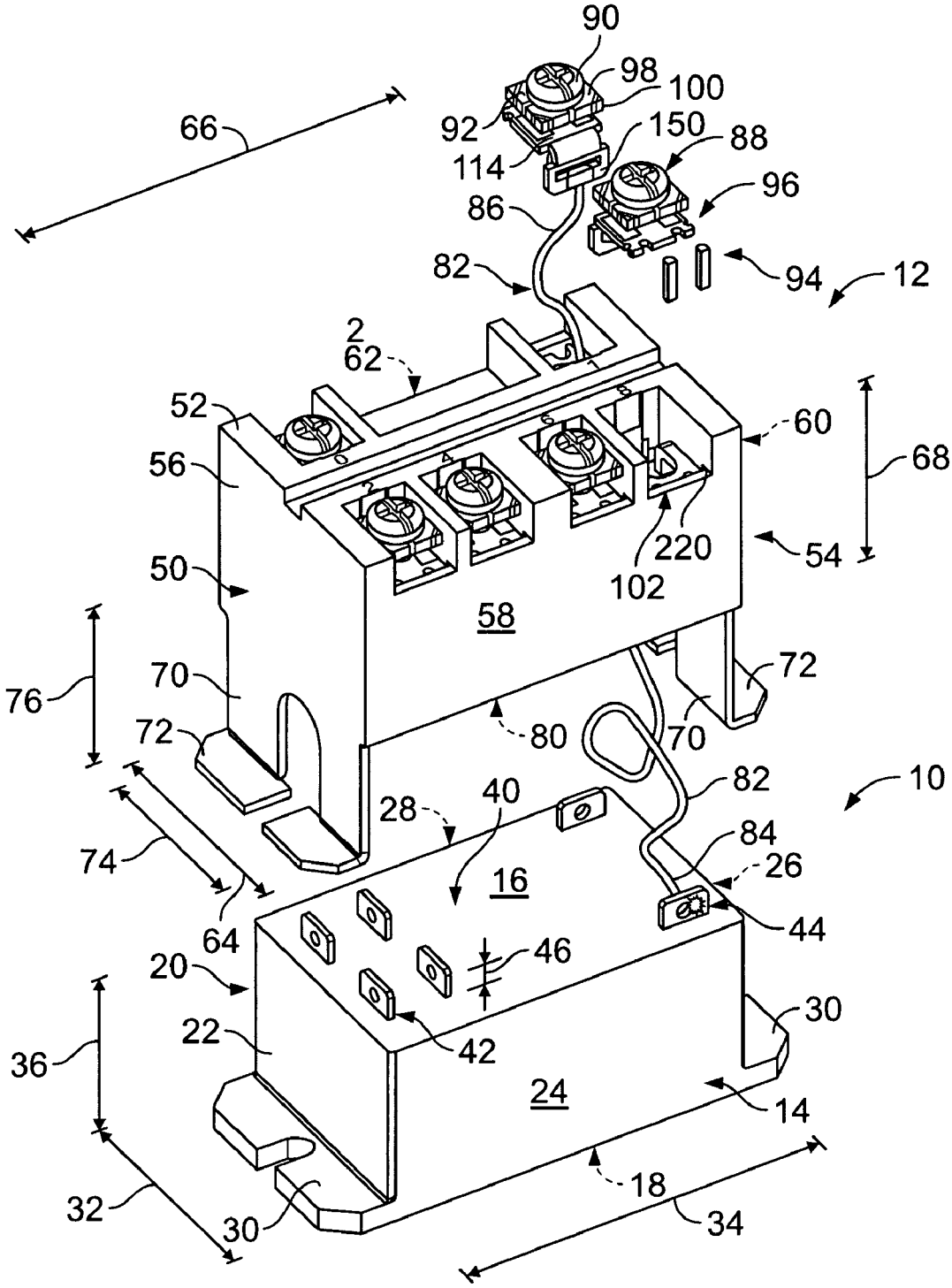
FIG. 1 is a partial exploded view of an electronic package including a terminal adapter assembly formed in accordance with an exemplary embodiment of the present invention.

FIG. 1 is a partial exploded view of an electronic package 10 in electrical communication with a terminal adapter assembly 12 according to an exemplary embodiment of the invention. As explained below, the terminal adapter assembly 12 reliably converts modified quick connect terminals of the electronic package 10 to screw terminals connections which more capably withstand torque requirements of certain applications, and while satisfying UL requirements for certain electronic packages.

In the exemplary embodiment, the electronic package 10 is rectangular in shape. In an alternative embodiment, the electronic package 10 may have any other shape, such as, but not limited to a square shape, or a circular shape. In the exemplary embodiment, the electronic package 10 is fabricated from a molded polypropylene material. In alternative embodiments, the electronic package 10 may be fabricated from any other suitable material that enables the electronic package 10 to function as described herein. In one embodiment, the electronic package 10 is based upon a T92 power relay switch package that is commercially available from Tyco Electronics Corporation of Middletown, Pa. wherein the quick connect terminals of the T92A switch package are modified to accommodate the adapter assembly 12. While the invention is described and illustrated in the context of a relay switch package, it is recognized that the benefits of the invention may accrue to other electronic packages. The embodiment set forth herein is therefore provided for illustrative purposes only and is but one potential application of the invention.

In an exemplary embodiment, the electronic package 10 includes a housing 14 that includes a top surface 16, a bottom surface 18, and a plurality of sidewalls 20 extending therebetween. Specifically, in the exemplary embodiment, the electronic package 10 includes a first sidewall 22, a second sidewall 24, a third sidewall 26, and a fourth sidewall 28. The first and third sidewalls 22 and 26 are substantially parallel to one another, and the second and fourth sidewalls 24 and 28 are substantially parallel one another. As such, the first and third sidewalls 22 and 26 are substantially perpendicular to the second and fourth sidewalls 24 and 28. A pair of mounting feet 30 extend from the bottom surface 18 substantially perpendicular to the first and third sidewalls 22 and 26.

The sidewalls 22 and 26 have a first length 32, and sidewalls 24 and 28 have a second length 34. In the exemplary embodiment, the length 32 is different than the length 34. Alternatively, the lengths 32 and 34 may be selected to be any length. Additionally, the sidewalls 20 have a height 36. In one embodiment, the first length 32 is approximately 1.36 inches and the second length 34 is approximately 2.04 inches. In one embodiment, the height 36 is approximately 1.04 inches. In alternative embodiments, first length 32, second length 34, and/or height 36 may be longer or shorter than the above indicated lengths and heights, depending upon the particular application.

In the exemplary embodiment, the electronic package top surface 16 includes a plurality of terminals 40 extending outwardly and substantially perpendicular from the top surface 16. The terminals 40 include six modified quick connect terminals including four coil terminals 42 positioned proximate sidewall 22 and two lead terminals 44 positioned proximate sidewall 26. The terminals of the switch package 10 are modified from their original quick connect configuration (not shown) by cutting off the ends of the quick connect terminals to form stub terminals extending from the top surface 16 for a specified length. The two coil terminals 42 are substantially parallel to the sidewall 22 and the four lead terminals 44 are substantially perpendicular to the sidewalls 26. Alternatively, the terminals 42 and 44 may be positioned and/or oriented differently than the above indicated positions and orientation, depending upon the particular application. Additionally, the terminals 44 have a height 46. In one embodiment, the height 46 is approximately 0.46 inches. In alternative embodiments, the height 46 may be taller or shorter than the above indicated height, depending upon the particular application.

In an exemplary embodiment, the terminal adapter assembly 12 is rectangular in shape and thus complimentary to the electronic package 10. In alternative embodiments, the terminal adapter assembly 12 may be designed to have a variety shapes and sizes to facilitate coupling with electronic package 10, such as, but not limited to a square shape, or a circular shape. In the exemplary embodiment, the terminal adapter assembly 12 is fabricated from a molded thermoplastic material. In alternative embodiments, the terminal adapter assembly 12 may be fabricated from any other suitable material that enables terminal adapter assembly 12 to function as described herein.

In an exemplary embodiment, the terminal adapter assembly 12 includes a nonconductive housing 50 that includes a top surface 52, a bottom surface (not shown), and a plurality of sidewalls 54 extending therebetween. Specifically, in the exemplary embodiment, the terminal adapter assembly 12 includes a first sidewall 56, a second sidewall 58, a third sidewall 60, and a fourth sidewall 62. The first and third sidewalls 56 and 60 are substantially parallel to one another, and the second and fourth sidewalls 58 and 62 are substantially parallel one another. As such, the first and third sidewalls 56 and 60 are substantially perpendicular to the second and fourth sidewalls 58 and 62. The sidewalls 56 and 60 have a first length 64, and the sidewalls 58 and 62 have a second length 66. In the exemplary embodiment, the length 64 is different than the length 66. Alternatively, the lengths 64 and 66 may be selected to be any length. Additionally, the sidewalls 54 have a height 68. In one embodiment, the first length 64 is approximately 2.13 inches and the second length 66 is approximately 1.42 inches. In one embodiment, the height 68 is approximately 1.07 inches. In alternative embodiments, first length 64, second length 66, and/or height 68 may be longer or shorter than the above indicated lengths and heights, depending upon the particular application.

In an exemplary embodiment, the terminal adapter assembly 12 includes a pair of mounting legs 70 extending downwardly from the sidewalls 56 and 60. Additionally, a pair of mounting feet 72 extend outwardly and substantially perpendicular from the sides 56 and 60 from the mounting legs 70. The legs 70 each have a length 74 and a height 76. In one embodiment, the length 74 is approximately 1.29 inches and the height 76 is approximately 1.07 inches. In alternative embodiments, length 74 and/or height 76 may be longer or shorter than the above indicated length and height, depending upon the particular application.

In an exemplary embodiment, the terminal adapter assembly 12 includes an adapter housing cavity 80 defined therein. More specifically, the housing cavity 80 is defined by the inner surface of sidewalls 54. Moreover, the housing cavity 80 receives at least a portion of the electronic package sidewalls 20 therein such that the electronic package sidewalls 22, 24, 26, and 28 are substantially adjacent to and surrounded by a portion of the terminal adapter assembly sidewalls 56, 58, 60, and 62, respectively. When the terminal adapter assembly 12 is coupled to the electronic package 10, the terminal adapter assembly mounting feet 72 are substantially adjacent the electronic package mounting feet 30 and the quick connect terminals 40 and an adapter wire 82 are enclosed within the cavity 80. In one embodiment, the mounting feet 72 may be coupled to the mounting feet 30 by a screw type fastener (not shown). Alternatively, the mounting feet 72 may be coupled to the mounting feet 30 by other fasteners, such as, but not limited to a rivet, or a chemical fastener, such as an adhesive.

In an exemplary embodiment, the terminal adapter assembly 12 includes a plurality of adapter wires 82 in electrical communication with electronic package 10. Specifically, the terminal adapter assembly 12 includes six adapter wires 82, although only one is shown in FIG. 1. Each wire 82 has a first end 84 and a second end 86. Each first end 84 is electrically coupled to each respective terminal 40 and each second end 86 is electrically coupled to a screw terminal assembly 88, described in greater detail below. In an exemplary embodiment, the wire ends 84 and 86 are soldered to their respective terminals 40 and 88. In alternative embodiments, the wire ends 84 and 86 are coupled to their respective terminals 40 and 88 according to other connection schemes known in the art.

In an exemplary embodiment, each screw terminal assembly 88 includes a screw 90, a pressure plate 92, and a pair of tooling pins 94, that engage a base plate 96 to secure the base plate 96 to the housing 50 in the manner explained below. In an exemplary embodiment, the pins 94 are attached to tooling (e.g., a tooling press) and are withdrawn after the base plates 96 of the terminal assemblies 88 are engaged to the housing 50, and thus the pins 94 are not actually present in the completed assembly.

In an exemplary embodiment, the screw 90 is a steel screw. In alternative embodiments, the screw 90 may be fabricated from any other suitable material that enables the screw 90 to function as described herein. The pressure plate 92 includes an opening (not shown), a top surface 98, and a plurality of corners 100. In an exemplary embodiment, the pressure plate 92 is square in shape. In alternative embodiments, the pressure plate 92 may have any other shape, such as, but not limited to a rectangular shape, or non-orthogonal shape, such as a circular shape. In the exemplary embodiment, the pressure plate 92 is fabricated from a low carbon steel C1008 material. In alternative embodiments, the pressure plate 92 may be fabricated from any other suitable material that enables the pressure plate 92 to function as described herein. The opening is sized to receive the screw 90 therein. The corners 100 are generally curved downwardly from a plane defined by the top surface 98 towards the base 94.

The tooling pins 94 facilitate coupling the screw terminal assembly 88 to the housing 50. Specifically, the tooling pins 94 are configured to engage and deflect the base plate 96 to couple each screw terminal assembly 88 to the housing 50 within a respective terminal receptacle 102, described in greater detail below. The tooling pins 94 are cylindrical in shape in an exemplary embodiment. In alternative embodiments, the tooling pins 94 may have any other shape, such as, but not limited to a cylindrical shape, a conical shape, a pyramid shape, a prism shape, and a curvilinear shape. In the exemplary embodiment, the tooling pins 94 are fabricated from a steel alloy material. In alternative embodiments, the tooling pins 94 may be fabricated from any other suitable material that enables the tooling pins 94 to function as described herein.

Figure 2:
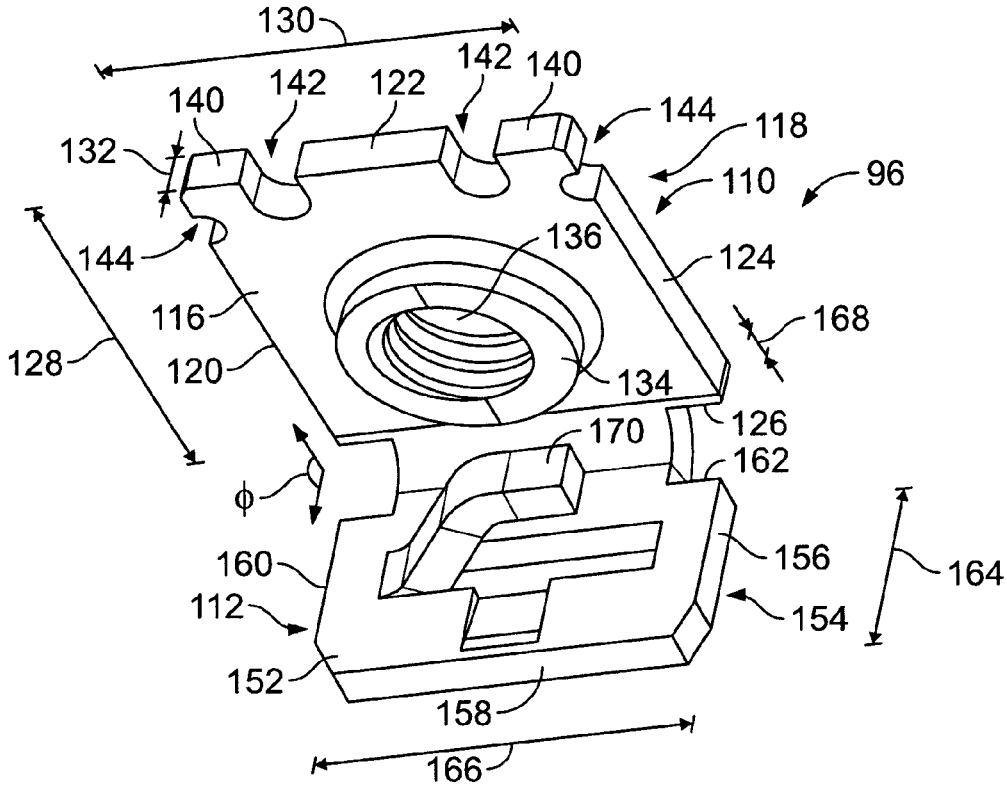
FIG. 2 is a perspective view of a terminal adapter element for the adapter assembly shown in FIG. 1.

FIG. 2 is a bottom perspective of base plate 96. In an exemplary embodiment, base plate 96 is substantially rectangular in shape. In alternative embodiments, base plate 96 may have any other shape, such as, but not limited to a square shape, or a non-orthogonal shape, such as a circle, or a curvilinear shape. In an exemplary embodiment, base plate 96 are fabricated from a plated copper allot material. In alternative embodiments, base plate 96 may be fabricated from any other suitable material that enables base plate 96 to function as described herein. In an exemplary embodiment, base plate 96 includes a screw terminal section 110 and a crimping section 112 and is formed into a L-shape such that an angle Φ is formed between screw terminal section 110 and crimping section 112. In an exemplary embodiment, angle Φ is 90 degrees. In alternative embodiments, angle Φ is greater than or less than 90 degrees.

In the exemplary embodiment, screw terminal section 110 includes a top surface 114 (shown in FIG. 1), a bottom surface 116, and plurality of sidewalls 118 extending therebetween. Specifically, in the exemplary embodiment, screw terminal section 110 includes a first sidewall 120, a second sidewall 122, a third sidewall 124, and a fourth sidewall 126. First and third sidewalls 120 and 124 are substantially parallel to one another, and second and fourth sidewalls 122 and 126 are substantially parallel one another. As such, first and third sidewalls 120 and 124 are substantially perpendicular to second and fourth sidewalls 122 and 126. Sidewalls 120 and 124 have a first length 128, and sidewalls 122 and 126 have a second length 130. In the exemplary embodiment, length 128 is different than length 130. Alternatively, lengths 128 and 130 may be selected to be any length. Additionally, sidewalls 54 have a height 132. In one embodiment, first length 128 is approximately 0.376 inches and second length 130 is approximately 0.352 inches. In one embodiment, height 132 is approximately 0.039 inches. In alternative embodiments, first length 128, second length 130, and/or height 132 may be longer or shorter than the above indicated lengths and heights, depending upon the particular application.

Screw terminal section bottom surface 116 includes a thread channel 134 extending downwardly from bottom surface 116. In an exemplary embodiment, channel 134 is cylindrical and hollow. In the exemplary embodiment, channel 134 is fabricated by a stamping/forming process. Alternatively, channel 134 may be fabricated by other processes, such as, but not limited to, a forming process, a milling process, or a grinding process. Channel 134 is configured to circumscribe an opening 136. Opening 136 is sized to receive screw 90 (shown in FIG. 1) therein.

The screw terminal section first sidewall 122 includes a pair of mounting legs 140 extending outwardly from sidewall 122 and a pair of pin grooves 142 extending inwardly from sidewall 122 and adjacent legs 140. In the exemplary embodiment, both legs 140 and pin grooves 142 are substantially parallel to sidewalls 120 and 124 and each other. As such, legs 140 and pin grooves 142 are substantially perpendicular to sidewalls 122 and 126. In an exemplary embodiment, legs 140 and pin grooves 142 are fabricated by a stamping process. Alternatively, legs 140 and pin grooves 142 may be fabricated by other processes, such as, but not limited to, a forming process, a milling process, or a grinding process.

The screw terminal section first and third sidewalls 120 and 124 include a pair of grooves 144 extending inwardly from sidewalls 120 and 124 and adjacent legs 140. In an exemplary embodiment, grooves 144 are substantially parallel to sidewalls 122 and 126 and opposite each other. As such, grooves 144 are substantially perpendicular to sidewalls 120 and 124. In the exemplary embodiment, grooves 144 are fabricated by a stamping process. Alternatively, the grooves 144 may be fabricated by other processes, such as, but not limited to, a forming process, a milling process, or a grinding process. The pin grooves 142 are sized to receive the pins 94 (shown in FIG. 1) therethrough such that inserting the pins 94 deflects the legs 140 outward toward the grooves 144. The pins 94 deflect the legs 140 such that the legs 140 extend beyond the plane of the sidewalls 120 and 124.

In the exemplary embodiment, crimping section 112 includes a outer surface 150 (shown in FIG. 1), an inner surface 152, and plurality of sidewalls 154 extending therebetween. Specifically, in an exemplary embodiment, screw terminal section 110 includes a first sidewall 156, a second sidewall 158, a third sidewall 160, and a fourth sidewall 162. First and third sidewalls 156 and 160 are substantially parallel to one another, and second and fourth sidewalls 158 and 162 are substantially parallel one another. As such, first and third sidewalls 156 and 160 are substantially perpendicular to second and fourth sidewalls 158 and 162. Sidewalls 156 and 160 have a first length 164, and sidewalls 158 and 162 have a second length 166. In the exemplary embodiment, length 164 is different than length 166. Alternatively, lengths 164 and 166 may be selected to be any length. Additionally, sidewalls 154 have a height 168. In one embodiment, first length 164 is approximately 0.186 inches and second length 166 is approximately 0.352 inches. In one embodiment, height 168 is approximately 0.039 inches. In alternative embodiments, first length 164, second length 166, and/or height 168 may be longer or shorter than the above indicated lengths and heights, depending upon the particular application.

Crimping section inner surface 152 includes a crimping member 170 extending inwardly from inner surface 152. In an exemplary embodiment, channel crimping member 170 is fabricated by a stamping process. Alternatively, crimping member 170 may be fabricated by other processes, such as, but not limited to, a forming process, a milling process, or a grinding process. Crimping member 170 is configured to receive adapter wire 86 therein.

Figure 3:
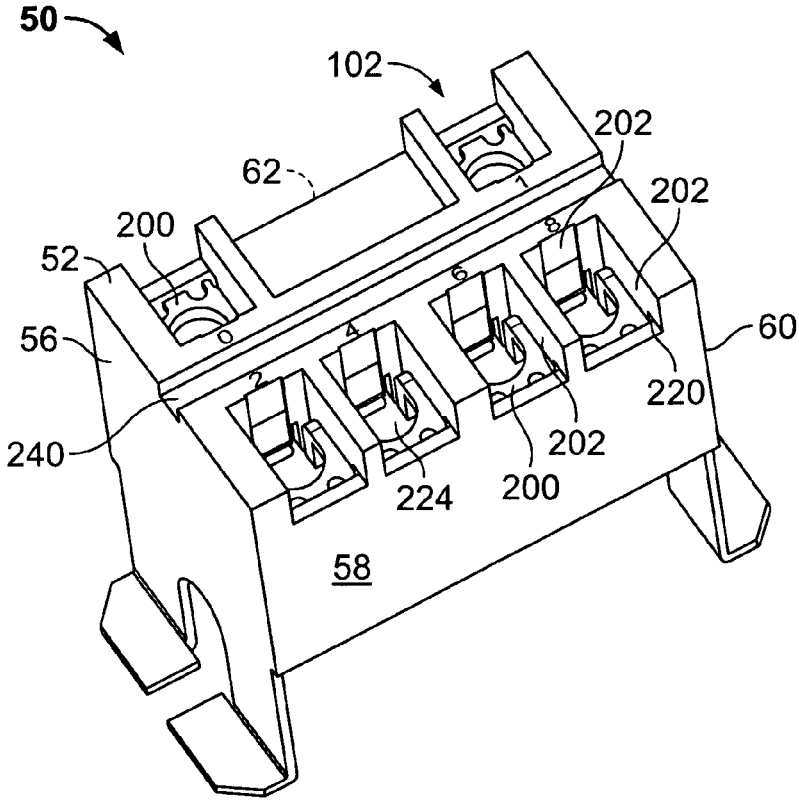
FIG. 3 is a perspective view of an adapter housing for the terminal adapter assembly shown in FIG. 1.
Figure 4:
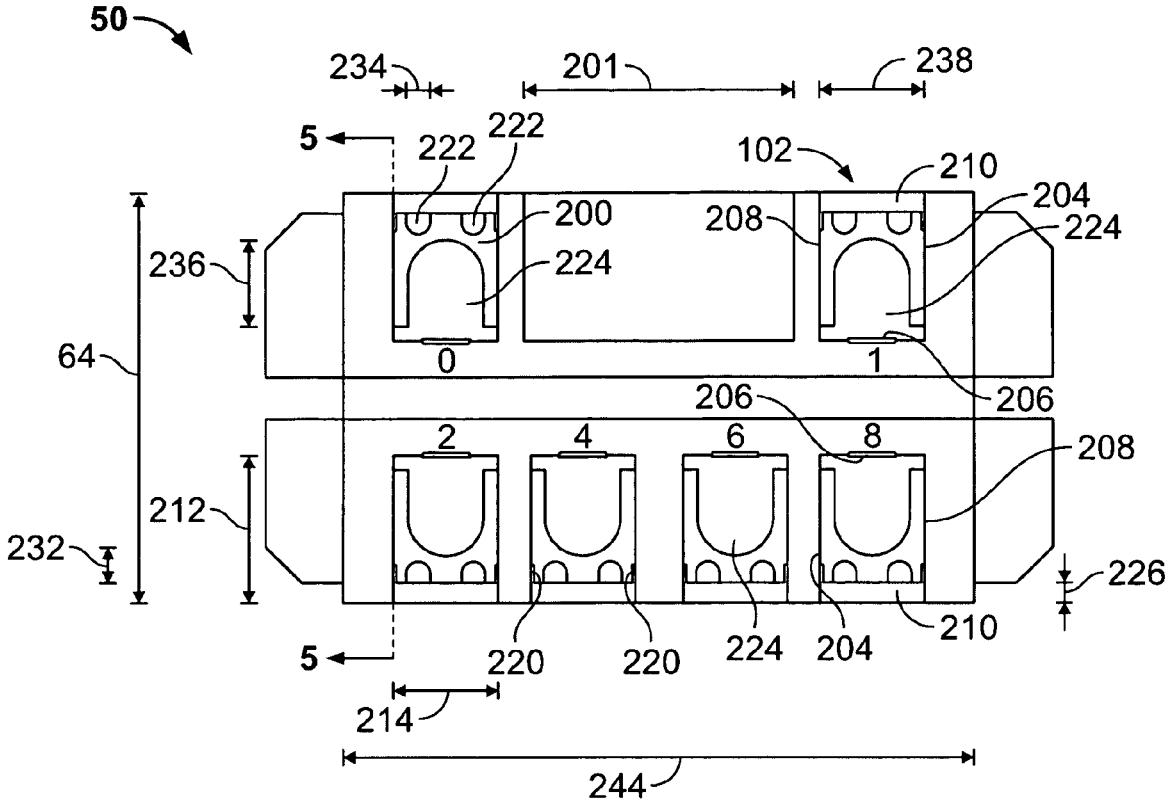
FIG. 4 is a top view of the housing shown in FIG. 3.
Figure 5:
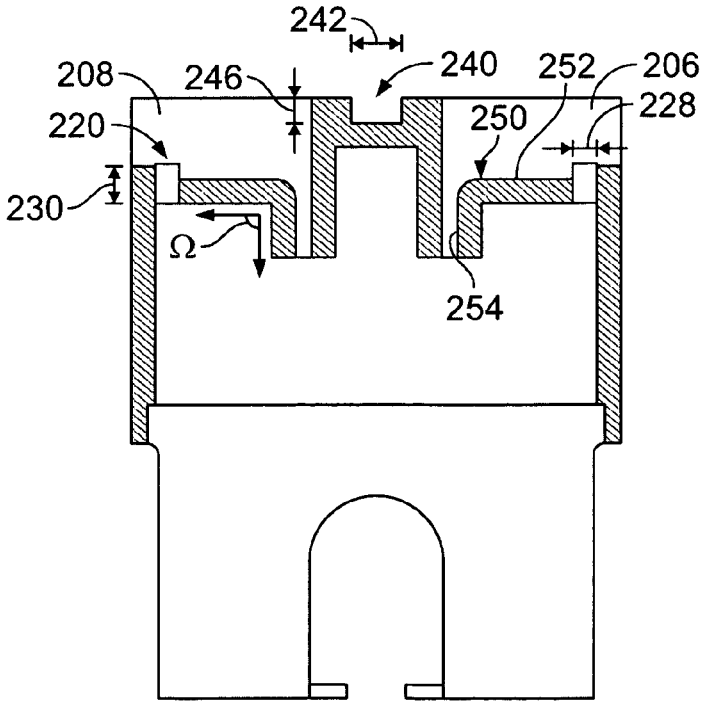
FIG. 5 is a sectional view of the housing shown in FIG. 4 along line 5—5.

FIG. 3 is a top perspective view of the adapter housing 50. FIG. 4 is a top view of adapter housing. FIG. 5 is a sectional view of adapter housing 50 along line 5—5 of FIG. 4. In an exemplary embodiment, the adapter housing top surface 52 includes six terminal receptacles 102 extending inwardly from the top surface 52 such that four coil terminal receptacles are positioned adjacent the sidewall 58 and adjacent one another and two lead terminal receptacles are positioned adjacent the sidewall 62 and spaced apart a length 201. In the exemplary embodiment, the length 201 is 0.917 inches. In alternative embodiments, the length 201 may be longer or shorter than the above indicated length, depending upon the number of the receptacles 102. The receptacles 102 are substantially parallel to the sidewalls 56 and 60 are substantially perpendicular to the sidewalls 58 and 62. Alternatively, the terminals receptacles 102 may include more or less and/or may be positioned differently than the above indicated number and positions, depending upon the particular application and the number of terminals 40 (shown in FIG. 1). In an exemplary embodiment, the terminal receptacles 102 are fabricated according to a molding process. Alternatively, the terminal receptacles 102 may be fabricated according to other known techniques.

In an exemplary embodiment, each terminal receptacle 102 includes a bottom surface 200 and a plurality of sidewalls 202. Specifically, in an exemplary embodiment, the receptacle 102 includes a first sidewall 204, a second sidewall 206, a third sidewall 208, and a fourth sidewall 210. The first and third sidewalls 204 and 208 are substantially parallel to one another, and the second and fourth sidewalls 206 and 210 are substantially parallel one another. As such, the first and third sidewalls 204 and 208 are substantially perpendicular to the second and fourth sidewalls 206 and 210. The sidewalls 204 and 208 have a first length 212, and the sidewalls 206 and 210 have a second length 214. In an exemplary embodiment, the length 212 is different than the length 214. Alternatively, the lengths 212 and 214 may be selected to be any length. In one embodiment, the first length 212 is approximately 0.447 inches and the second length 214 is approximately 0.357 inches. In alternative embodiments, the first length 212 and the second length 214 may be longer or shorter than the above indicated lengths, depending upon the particular application.

In an exemplary embodiment, each receptacle 102 includes a plurality of recessed cavities 220, a plurality of pin receptacles 222, and a wire opening 224. In an exemplary embodiment, the recessed cavities 220 are rectangular in shape. In alternative embodiments, the recessed cavities 220 may have any other shape, such as, but not limited to a square shape, or a non-orthogonal shape, such as a circle, or a curvilinear shape.

Each recessed cavity 220 is sized to receive at least a portion of each deflectable mounting leg 140 (shown in FIG. 2) therein. Specifically, when the tooling pins 94 (shown in FIG. 1) are inserted through screw assembly pin grooves 142 into pin receptacles 222, the screw assembly mounting legs 140 are deflected into each respective recessed cavity 220 such that each screw terminal assembly 88 (shown in FIG. 2) is locked into position within each terminal receptacle 102. Once the mounting legs 140 are deflected, the tooling pins 94 are withdrawn, although it is contemplated that in another embodiment, the pins 94 could be permanently inserted.

In the exemplary embodiment, each of the recessed cavities 220 has a first length 226 and a second length 228. In an exemplary embodiment, the length 226 is equal to the length 228. Alternatively, the lengths 226 and 228 may be selected to be any length. Additionally, the recessed cavities 220 have a height 230. In one embodiment, the first length 226 is approximately 0.060 inches and the second length 228 is approximately 0.060 inches. In one embodiment, the height 230 is approximately 0.114 inches. In alternative embodiments, first length 226, second length 228, and/or height 230 may be longer or shorter than the above indicated lengths and heights, depending upon the particular application.

In an exemplary embodiment, the pin receptacles 222 are circular in shape. In alternative embodiments, the pin receptacles 222 may have any other shape, such as, but not limited to a square shape, a rectangular shape, or a curvilinear shape. Each pin receptacle 222 is sized to facilitate the receipt of at least a portion of each tooling pin 94 (shown in FIG. 1) therein such that each screw terminal assembly 88 (shown in FIG. 2) is locked into position within each of the terminal receptacles 102. In an exemplary embodiment, each pin receptacle 222 has a first length 232 and a second length 234. In an exemplary embodiment, the length 232 is different than the length 234. Alternatively, the lengths 232 and 234 may be selected to be any length. In one embodiment, the first length 232 is approximately 0.076 inches and the second length 234 is approximately 0.080 inches. In alternative embodiments, the first length 232 and the second length 234, may be longer or shorter than the above indicated lengths, depending upon the particular application.

In an exemplary embodiment, the wire opening 224 is circular in shape. In alternative embodiments, the wire opening 224 may have any other shape, such as, but not limited to a square shape, a rectangular shape, or a curvilinear shape, such as an oval shape. Each wire opening 224 is sized to receive at least a portion of each adapter wire 82 (shown in FIG. 1). In the exemplary embodiment, each wire opening 224 has a first length 236 and a second length 238. In an exemplary embodiment, the length 236 is different than the length 238. Alternatively, the lengths 236 and 238 may be selected to be any length. In one embodiment, the first length 236 is approximately 0.076 inches and the second length 238 is approximately 0.080 inches. In alternative embodiments, first length 236 and second length 238, may be longer or shorter than the above indicated lengths, depending upon the particular application.

In an exemplary embodiment, the adapter housing top surface 52 further includes a channel 240 extending inwardly from the top surface 52. The channel 240 is rectangular in shape. In alternative embodiments, the channel 240 may have any other shape, such as, but not limited to a square shape, or a non-orthogonal shape, such as a circular shape, or a curvilinear shape. In an exemplary embodiment, the channel 240 is fabricated by a molding process. Alternatively, the channel 240 may be fabricated by other processes, such as, but not limited to, a forming process, a milling process, or a grinding process.

The channel 240 spaces lead terminals from coil terminals. In the exemplary embodiment, the channel 240 has a first length 242 and a second length 244. In an exemplary embodiment, the length 242 is different than the length 244. Alternatively, the lengths 242 and 244 may be selected to be any length. Additionally, the channel 240 has a height 246. In one embodiment, the first length 242 is approximately 0.160 inches and the second length 244 is approximately 2.13 inches. In one embodiment, the height 246 is 0.080 inches. In alternative embodiments, first length 242, second length 244, and/or height 246 may be longer or shorter than the above indicated length and height, depending upon the particular application.

Each receptacle 102 further includes a support member 250. In an exemplary embodiment, the support member 250 is rectangular in shape. In alternative embodiments, the support member 250 may have any other shape, such as, but not limited to a square shape, or a curvilinear shape. The support member 250 facilitates supporting each screw terminal assembly 88 within each receptacle 102. In an exemplary embodiment, the support member 250 includes a first surface 252 and a second surface 254 and is formed into a L-shape such that an angle Ω is formed. In the exemplary embodiment, the angle Ω is equal to the angle Φ (FIG. 2). In an exemplary embodiment, the angle Ω is 90 degrees. In alternative embodiments, the angle Ω is greater than or less than 90 degrees. The size and shape of support member 250 compliments and cooperates with the base plate 96 such that the screw terminal bottom surface 116 is substantially adjacent to the support member first surface 252 and the crimping section inner surface 152 is substantially adjacent to the support member second surface 254.

Returning to FIG. 1, the exemplary embodiment includes the electronic package 10 with six terminals 40 positioned on the top surface 16. The first end 84 of each of the six adapter wires 82 are soldered to each of the terminals 40 and then traversed through each respective wire opening 224 in the terminal adapter assembly 12. Each adapter wire second end 86 is coupled to a respective screw assembly base plate crimping section 112 (shown in FIG. 2). The terminal adapter 12 is positioned over the electronic package such that the electronic package sidewalls 22, 24, 26, and 28 are substantially adjacent to and surrounded by a portion of the terminal adapter assembly sidewalls 56, 58, 60, and 62, respectively. The terminal adapter assembly mounting feet 72 are coupled to the electronic package mounting feet 30 such that the quick connect terminals 40 and the adapter wires 82 are enclosed and hidden from view within the cavity 80.

Returning to FIGS. 2 and 3, each screw assembly base plate 96 is then inserted into a respective receptacle 102 such that base plate pin grooves 142 are aligned with receptacle pin receptacles 222. The tooling pins 94 are inserted through the pin grooves 142 and into the pin receptacles thus deflecting screw assembly mounting legs 140 into adjacent receptacle recessed cavities 220, and the tooling pins 94 are subsequently withdrawn from the assembly. The deflected mounting legs 140 secure base plate 96 to receptacle 102. Each screw assembly base plate 96 is configured to receive one screw 90 coupled with and one pressure plate 92. The screw 90 and the pressure plate 92 are spaced from the base plate 96 to permit coupling with an inserted wire. Screw 90 and pressure plate 92 may be tightened with the required amount of torque to secure the inserted wire to the screw assembly 88 and thus the terminal adapter assembly 12.

Coupling the terminal adapter assembly 12 to electronic package 10 provides several benefits. Because screw terminal assemblies 88 are fitted and secured in receptacles 102 with deflecting mounting legs 140, screws 90 can be tightened to the required amount of torque. Because screw terminal assemblies 88 are secured within receptacles 102, adapter assembly 12 meets the UL requirements for air gaps and terminal spacing. Additionally, adapter assembly 12 is a convenient and reliable to maintain and facilitate converting stub terminals into screw terminals. In one exemplary application, the adapter assembly reliably converts modified quick connect terminals to screw terminals.

While the invention has been described in terms of various specific embodiments, those skilled in the art will recognize that the invention can be practiced with modification within the spirit and scope of the claims.

What is claimed is:

1. A terminal adapter for an electronic package having a quick connect terminal, said adapter comprising:

an adapter housing configured to be fitted over electronic package and the enclosing the terminal of the electronic package;

a terminal receptacle formed in said housing; and at least one screw terminal assembly fitted within said terminal receptacle and locked thereto with deflectable mounting legs, said screw terminal assembly comprising pins staked into said adapter housing and deflecting said deflectable mounting legs for coupling said screw terminal assembly to said adapter housing.

2. A terminal adapter in accordance with claim 1 wherein said terminal receptacle includes recessed cavities which receive said legs when deflected.

3. A terminal adapter in accordance with claim 1 wherein said screw terminal assembly includes a base plate configured for crimping to a wire.

4. A terminal adapter in accordance with claim 1 wherein said screw terminal assembly includes a crimping section and a screw terminal section, said crimping section and said screw terminal section extending at substantially right angles to one another.

5. A terminal adapter in accordance with claim 1 wherein said screw terminal assembly is connected to the quick connect terminal with a wire.

6. A terminal adapter for an electronic package having a plurality of quick connect terminals, said adapter comprising:

an adapter housing configured to be fitted over the electronic package and enclosing the quick connect terminals of the electronic package;

a plurality of terminal receptacles formed in said housing, each of said terminal receptacles corresponding to one of the quick connect terminals of the electronic package; and a plurality of screw terminal assemblies, each screw terminal assembly fitted within a respective one of said terminal receptacles, a portion of each screw terminal assembly projecting into retaining cavities formed into said terminal receptacles to prevent said screw terminal assemblies from moving with respect to said housing when said screw terminal assemblies are lightened.

7. A terminal adapter in accordance with claim 6 wherein each of said screw terminal assemblies include deflectable mounting legs which are received in said cavities.

8. A terminal adapter in accordance with claim 6 wherein said terminal assembly further includes pins extending through a portion of each said screw terminal assembly to stake said screw terminals to said housing.

9. A terminal adapter in accordance with claim 6 wherein said terminal receptacle each include opposite side walls, and each said side wall includes a recessed cavity therein which receive said portion of said screw terminal assembly.

10. A terminal adapter in accordance with claim 6 wherein at least one of said screw terminal assemblies includes a base plate configured for crimping to a wire.

11. A terminal adapter in accordance with claim 6 wherein at least one of said screw terminal assemblies includes a crimping section and a screw terminal section, said crimping section and said screw terminal section extending at substantially right angles to one another.

12. A terminal adapter in accordance with claim 6 wherein at least one of said screw terminal assemblies is connected to one of the quick connect terminals with a wire.

13. An electronic package assembly comprising:

an electronic package having a plurality of quick connect terminals;

an adapter housing configured to be fitted over the electronic package and the quick connect terminals of the electronic package, said housing including a plurality of terminal receptacles, each of said terminal receptacles corresponding to one of the quick connect terminals of the electronic package; and a plurality of screw terminal assemblies, each screw terminal assembly fitted within a respective one of said terminal receptacles, a portion of each screw terminal assembly projecting into retaining cavities formed into said terminal receptacles to prevent said screw terminal assemblies from moving with respect to said quick connect terminals when said screw terminal assemblies are tightened.

14. An electronic package assembly in accordance with claim 13 wherein each of said screw terminal assemblies include deflectable mounting legs which are received in said cavities.

15. An electronic package assembly in accordance with claim 13 wherein said terminal assembly further includes pins extending through a portion of each said screw terminal assembly to stake said screw terminals to said housing.

16. An electronic package assembly in accordance with claim 13 wherein said terminal receptacle each include opposite side walls, and each said side wall includes a recessed cavity therein which receive said portion of said screw terminal assembly.

17. An electronic package assembly in accordance with claim 13 wherein at least one of said screw terminal assemblies is connected to one of the quick connect terminals with a wire.

18. An electronic package assembly in accordance with claim 13 wherein said adapter housing encloses said quick connect terminals.

19. An electronic package assembly in accordance with claim 13 wherein said electronic package is a relay switch package including at least one of a quick connect coil terminal and a quick connect load terminal.

* * * * *